US007744420B2

(12) United States Patent
Morlion et al.

(10) Patent No.: US 7,744,420 B2
(45) Date of Patent: Jun. 29, 2010

(54) CONNECTOR SYSTEM FOR CONNECTING A FIRST PART AND A SECOND PART, CONNECTOR ASSEMBLY AND DEVICE BOARD

(75) Inventors: Danny Louis Cornelius Morlion, Ghent (BE); Stefaan Hendrik Josef Sercu, Velddriel (NL)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/387,500

(22) Filed: May 4, 2009

(65) Prior Publication Data

US 2009/0221183 A1 Sep. 3, 2009

Related U.S. Application Data

(62) Division of application No. 12/080,738, filed on Apr. 4, 2008, now Pat. No. 7,527,527, which is a division of application No. 10/523,903, filed as application No. PCT/EP03/50327 on Jul. 22, 2003, now abandoned.

(30) Foreign Application Priority Data

Aug. 5, 2002 (NL) ..... 1021208

(51) Int. Cl.
*H01R 24/00* (2006.01)

(52) U.S. Cl. ..... 439/620.22

(58) Field of Classification Search ..... 439/76.1, 439/620.21, 620.22
See application file for complete search history.

(56) References Cited

U.S. PATENT DOCUMENTS 5,037,308 A * 8/1991 Bryce et al. ..... 439/52
5,037,313 A 8/1991 Linden et al. ..... 439/76
5,043,949 A 8/1991 Shechter ..... 367/76
5,118,300 A 6/1992 Zarreii ..... 439/79
5,177,404 A 1/1993 Cohen et al. ..... 315/154
5,299,942 A * 4/1994 Burke et al. ..... 439/79
5,415,556 A * 5/1995 Schroll ..... 439/77
5,675,813 A * 10/1997 Holmdahl ..... 713/310
5,769,645 A 6/1998 Martin et al. ..... 439/79
6,047,379 A 4/2000 Larabell et al. ..... 713/300
6,126,463 A 10/2000 Okazaki et al. ..... 439/188
6,160,485 A 12/2000 Krakovich ..... 340/635

(Continued)

FOREIGN PATENT DOCUMENTS

EP 1 220 376 A2 7/2002
JP 11176519 7/1999
WO WO 97/06514 2/1997
WO WO 02/17053 A1 8/2000

*Primary Examiner*—Neil Abrams
(74) *Attorney, Agent, or Firm*—Harrington & Smith

(57) ABSTRACT

A method including providing a connector having a plurality of signal contacts and non-signal contacts. A circuit trace element is provided to be disposed within the connector. The circuit trace element has a ground structure. The circuit trace element has at least two non-signal traces, a first one of the non-signal traces being electrically connected to the ground structure by a connection within the circuit trace element and a second one of the non-signal traces being connectable to the ground structure through a separate electrical component. The second non-signal trace may serve to power an active signal conditioning element within the second connector or, in the absence of the active signal conditioning element, may be connected to the ground structure through the separate electrical component.

17 Claims, 3 Drawing Sheets

U.S. PATENT DOCUMENTS 6,330,164 B1 * 12/2001 Khandros et al. ..... 361/760
6,379,184 B1 4/2002 Bassler et al. ..... 439/607
6,496,626 B2 12/2002 Spagnoletti et al. ..... 385/101
6,561,849 B2 5/2003 Naito et al. ..... 439/607
6,796,806 B2 9/2004 Boutros et al. ..... 439/76.1
6,803,655 B2 * 10/2004 Fujio et al. ..... 257/724
6,902,433 B1 * 6/2005 Hashimoto et al. ..... 439/620.15

* cited by examiner

CONNECTOR SYSTEM FOR CONNECTING A FIRST PART AND A SECOND PART, CONNECTOR ASSEMBLY AND DEVICE BOARD

CROSS REFERENCE TO RELATED APPLICATION

This is a divisional patent application of application Ser. No. 12/080,738 filed Apr. 4, 2008, now U.S. Pat. No. 7,527,527, which is a divisional patent application of application Ser. No. 10/523,903 filed Aug. 19, 2005, now abandoned which is a national stage patent application of International Application No. PCT/EP2003/050327 filed Jul. 22, 2003 which claims priority on Netherlands patent application No. 1021208 filed Aug. 5, 2002.

FIELD OF THE INVENTION

The invention relates to a connector system for a first part and a second part, wherein:

said first part comprises a power supply line, a plurality of signal contacts and a plurality of ground contacts said second part comprises a plurality of corresponding signal contacts and a plurality of corresponding ground contacts

BACKGROUND OF THE INVENTION

It is well known that signals that are transmitted over a cable will degrade with regard to their initial characteristics. This degradation may depend on several factors, such as the length of the cable over which the signals are transmitted or the frequency of the signals being transmitted.

To account for this degradation behavior, signals are manipulated to improve the overall quality of the transmitted signal. In a simple approach, manipulation of the signals is achieved by using passive compensation. In this approach electronic circuits comprising passive components such as resistors, capacitors and inductors are used. These passive components may be applied on e.g. a device board or printed circuit board (PCB's). Alternatively, the passive components can be applied in a connector assembly at the side intended to mate with the device board for transmitting the signals.

However, in many circumstances passive compensation is inadequate to maintain the quality of the transmitted signals at the required level. This may e.g. be the case if the length of the cable that transmits the signals exceeds a certain limit. In such a case, active compensation is required. Active compensation is a known technique for manipulating signals. Electronic circuits, performing active compensation tasks, are conventionally applied at the device board. The power for such an electronic circuit for performing these compensation tasks is acquired from a power source on the device board.

Since it is not known beforehand what type of cable, with respect to e.g. the cable length, is going to be connected to the device board, the prior art approach is to apply an active compensation circuit on the device board to allow any connection of any type of cable. This approach is rather inefficient and expensive.

SUMMARY OF THE INVENTION

It is an object of the invention to provide a solution for these and other problems of the prior art.

This object is achieved by providing a connector system for a first part and a second part, characterized in that said power supply line is connected to at least one ground contact of said first part and extended into said second part by a connection between said ground contact and a corresponding ground contact of said second part. By implementing the electronic circuit for active compensation in the second part (e.g. a connector assembly), the first part (e.g. the device board) may be designed without the active compensation circuit. Only when active compensation is actually required, an electronic circuit for performing active compensation tasks has to be applied in the second part. The electronic circuit in the second part is powered via the power supply line from the first part via suitable ground contacts of the first and second part. The invention thus involves a more efficient and less expensive approach with regard to signal manipulation. The cable assembly may comprise also electronic circuits that manipulate or process the signal on transmitting or receiving such a signal.

In an embodiment of the invention the first part is a PCB or device board and the second part is a connector assembly for transmitting signals over a cable to a third part. This third part may be another PCB or device board. The cable assembly may comprise electronic circuits powered according to the invention on both sides.

In an embodiment of the invention the connector assembly is adapted to isolate said power supply line from said cable. This ensures that, while a voltage is applied to the electronic circuit in the cable connector, the cable does not transmit the voltages further as to avoid dangerous situations or conflicts with regulatory requirements.

The invention also relates to a connector assembly for use in such as system. The connector assembly comprising an electronic circuit is adapted as to receive a voltage from a power supply line in the first part via a suitable ground pin. The arrangement is such that this voltage is not carried further in the cable to a third part.

The invention also relates to a device board for use in a connector system. At least one of the ground pins of such a device board or connector thereof is dedicated to be fed by a power supply line as to provide power to a cable connector or assembly.

U.S. Pat. No. 5,037,313 discloses an active plug-in part comprising an electronic circuit in a cable connector. The publication however does not disclose how the electronic circuit is powered.

BRIEF DESCRIPTION OF THE DRAWINGS

The embodiments of the invention will be described into more detail below with reference to the attached drawing of which FIG. 1 schematically illustrates a connector system for a device board and a connector assembly according to the prior art.

DETAILED DESCRIPTION OF THE INVENTION

Figure 1:
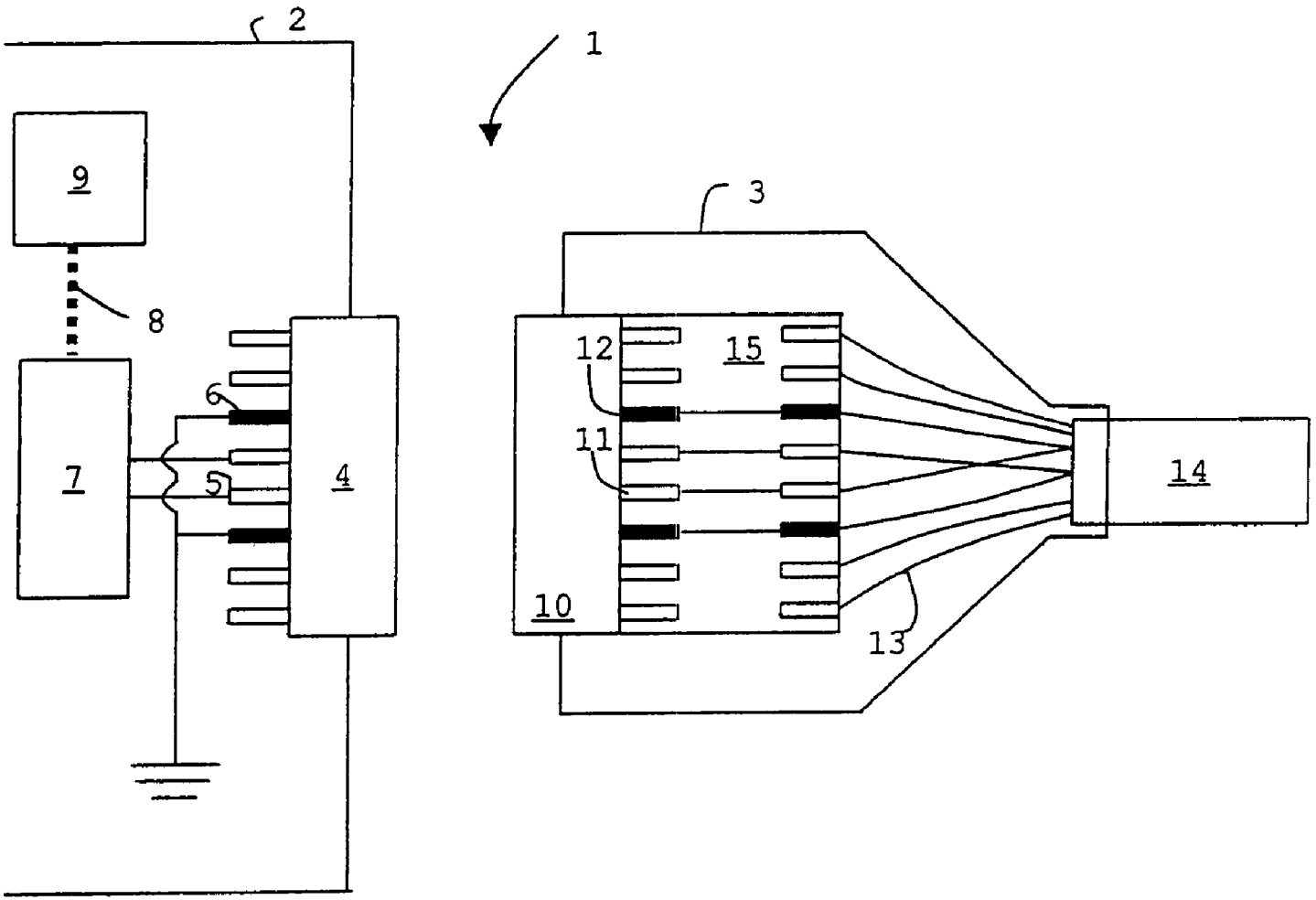
PRIOR ART Fig. 1

In FIG. 1 a system 1 for connecting a first part 2 and a second part 3 is shown according to the prior art. The first part 2 will hereinafter be referred to as device board 2. The second part 3 will hereinafter be referred to as connector assembly 3. Device board 2 comprises a connector 4, comprising signal contacts 5 and ground contacts 6. The signals from the device board 2 can be manipulated by the electronic circuit 7. This electronic circuit 7 performs active compensation tasks for signals to be transmitted through the connector assembly 3. The electronic circuit 7 is powered over the power supply line 8, indicated by the thick dashed line, by the voltage source 9 present at the device board side. It is noted that the voltage source 9 is not necessarily an integral part of the device board 2.

The connector assembly 3 comprises a connector 10 comprising signal contacts 11 corresponding to the signal contacts 5 of the device board 2 and ground contacts 12 corresponding to the ground contacts 6 of the device board 2. The contacts 11 and 12 are connected via wires 13 and are connected to the cable 14. In most cases a board or card 15 is provided to connect the contacts 11 and 12 with the wires 13 of the cable 14.

Figure 2:
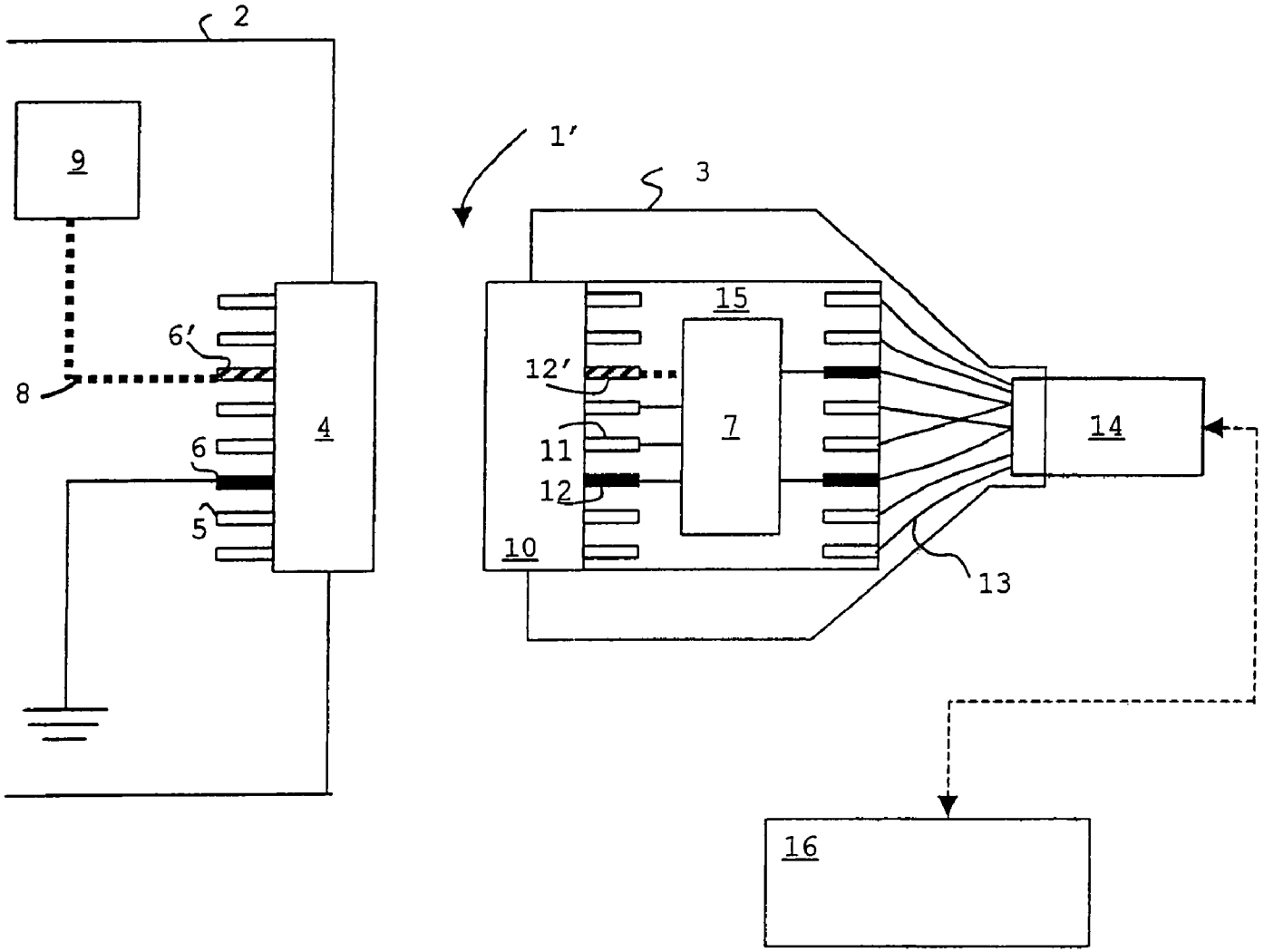
FIG. 2 schematically illustrates a connector system for a device board and a connector assembly comprising an electronic circuit according to an embodiment of the invention.

In FIG. 2 a system 1' for connecting a first part 2 and a second part 3 according to an embodiment of the invention are shown. Parts of the system 1' that are similar or identical to the parts displayed for the system 1 in FIG. 1 are indicated by the same reference numerals.

In the embodiment of the invention the electronic circuit 7 is part off the connector assembly 3, e.g. by accommodating the electronic circuit 7 on a board or card 15 mounted to or within the connector assembly 3 or cable connector 10. The electronic circuit 7 is powered from the voltage source 9 by assigning or dedicating at least one of the ground contacts 6 for connection to the power supply line 8. This contact 6' of connector 4 of the device board 2 has a corresponding contact 12' for extending the power supply line 8 into the connector assembly 3 as to apply the voltage to the electronic circuit 7. The voltage supply path 8 is indicated by the thick dashed line in FIG. 2. The other ground contacts 6 and corresponding ground contacts 12 remain to be used for grounding purposes. Moreover, FIG. 2 illustrates that the power supply line is isolated from the wires 13 of the cable 14 to avoid the wires 13 to carry a substantive voltage over the cable 14 to a third part 16.

In operation of the system 1', the device board 2 and connector assembly 3 are connected to each other by connecting the connectors 4 and 10 such that the signal contacts 5 and 11 and the ground contacts 6 and 12 meet. In that case the contacts 6' and 12' also connect as a result of which the voltage source 9 is connected to the electronic circuit 7 via the power supply line 8 that extends into the connector assembly 2. Thus, the electronic circuit 8 is powered from the device board 2.

Since the electronic circuit 7 is powered, signals transmitted over the signal contacts 5 and 11 can be manipulated in order to optimize these signals and transmit them to e.g. the third device 16. The electronic circuit 8 may e.g. be an active equalization device. Connector assemblies comprising such active compensation devices only have to be applied if e.g. the length of cable 14 exceeds a certain limit. It is noted that the electronic circuit may comprise passive components.

Figure 3:
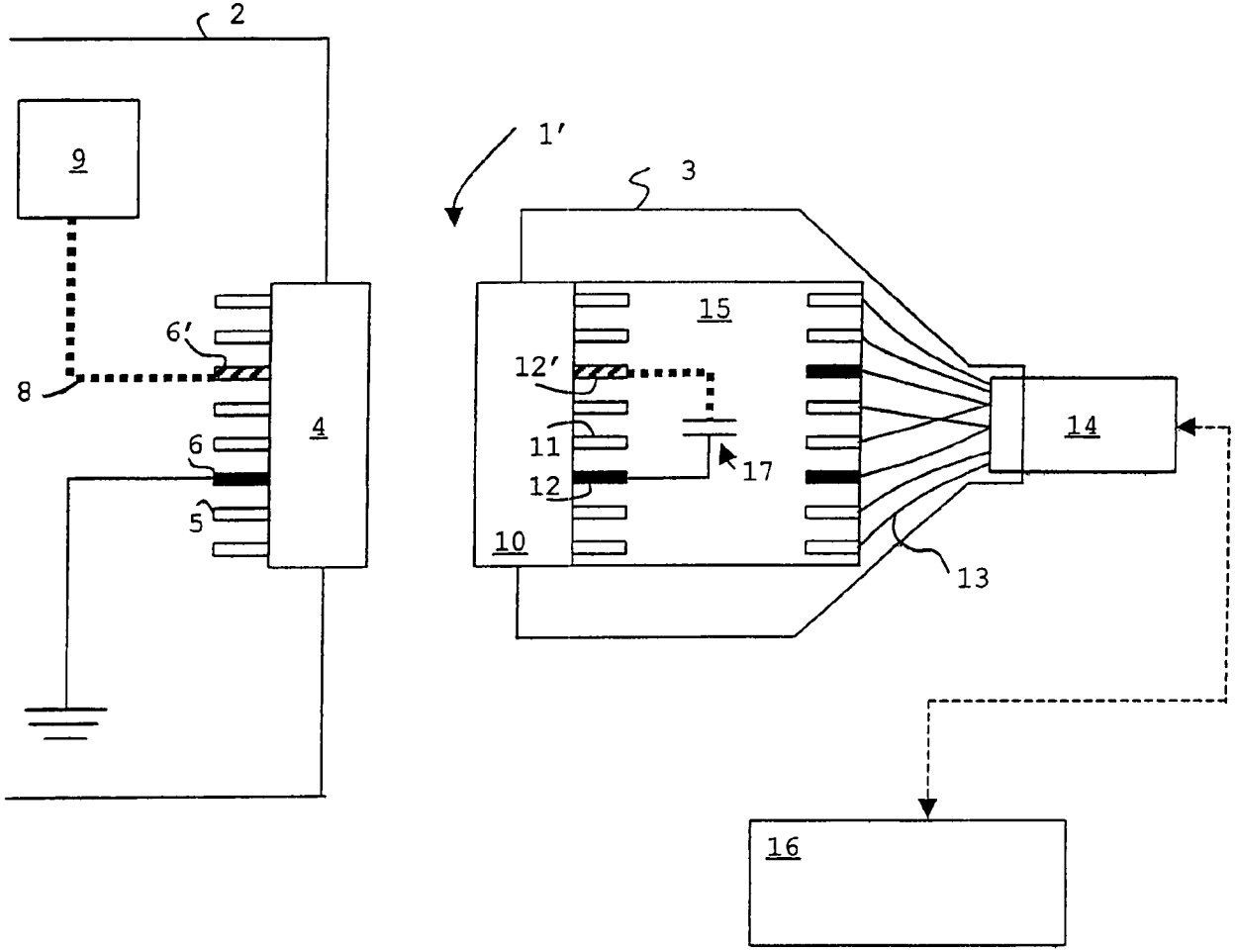
FIG. 3 schematically illustrates a connector system for a device board and a connector assembly without an electronic circuit according to an embodiment of the invention.

In FIG. 3 the situation is illustrated wherein the board 15 does not comprise an electronic circuit 7. However, the device board 2 still connects the power supply line 8 to the ground contact 6' thereby extending the power supply line via the corresponding ground contact 12' into the cable assembly 3. In such a case the cable assembly 3 for the cable 14 may still be used, since the board 15 of the cable assembly 3 may comprise e.g. a capacitor 17 grounded via the remaining ground contacts 12 and 6 at the ground of e.g. the device board 2. As an alternative the corresponding ground contact 12' is isolated in the cable assembly 3.

For the purpose of teaching the invention, a preferred embodiment of the system for transmitting signals and a connector have been described above. It will be apparent for the person skilled in the art that other alternative and equivalent embodiments of the invention can be conceived and reduced to practice without departing from the true spirit of the invention.

The invention claimed is:

1. A method of reducing the cost of alternatively providing actively equalized cable assemblies and non-actively equalized cable assemblies comprising:

providing a connector having a plurality of signal contacts and non-signal contacts in a predetermined arrangement, the connector including structure for mounting the connector on an electrical cable; and providing a circuit element to be disposed within the connector, the circuit element having signal conductors and non-signal conductors associated with the signal and non-signal contacts, the circuit element having a ground structure, the circuit element having at least two of the non-signal conductors, a first one of the non-signal conductors being electrically connected to the ground structure by a connection within the circuit element and a second one of the non-signal conductors being connectable to the ground structure through a separate electrical component, whereby the second non-signal conductor is configured to serve to power an active signal conditioning element within the connector, and wherein the second non-signal conductor is configured to alternatively be connected to the ground structure through the separate electrical component when the connector is free of the active signal conditioning element.

2. A method as in claim 1, wherein the second non-signal conductor is arranged to provide power to the active signal conditioning element associated with the connector, and wherein the first non-signal conductor is arranged to return power from the active signal conditioning element through the ground structure.

3. A method as in claim 1, wherein the separate electrical component comprises a passive element.

4. A method as in claim 1, wherein the passive element comprises a capacitor connecting the first non-signal conductor to the second non-signal conductor.

5. A method comprising:

providing a first electrical connector having an array of contacts adapted to be connected to a similar array of contacts in a second electrical connector, the array of contacts including at least one signal conductor and at least two non-signal conductors, and wherein the first electrical connector comprises:

structure adapted to mount the first electrical connector to an electrical cable; and an electronic assembly comprising an electronic circuit including a power receiving component, and the array of contacts connected to the electronic circuit, wherein the array of contacts comprises signal contacts and non-signal contacts, wherein the non-signal contacts comprise a ground contact and a power contact arranged in the predetermined arrangement, wherein the power receiving component is configured to comprise an active signal conditioning element and be connected between the ground contact and the power contact, and wherein the power receiving component is alternatively configured to comprise a passive electrical component and be connected between the ground contact and the power contact.

6. A method as in claim 5 further comprising:

when the power receiving component is configured to comprise the active signal conditioning element, the connector manipulates signals transmitted over the signal contacts, and when the power receiving component is alternatively configured to comprise the passive electrical component, the second connector does not manipulate signals transmitted over the signal contacts.

7. A method as in claim 5 further comprising:

providing the electrical cable with a first shorter length when the power receiving component is alternatively configured to comprise the passive electrical component, and alternatively providing the electrical cable with a second longer length when the power receiving component is configured to comprise the active signal conditioning element.

8. A method as in claim 5 wherein the active signal conditioning element comprises an active equalization device adapted to improve quality of signals transmitted through the electrical connector, wherein the active equalization device is powered, in operation, by the power from the power contact.

9. A method as in claim 5 further comprising the electrical connector preventing substantive voltage from the non-signal contacts from being carried by the cable.

10. A method of manufacturing an electrical connector comprising:

providing a structure adapted to mount the electrical connector to an electrical cable;

providing an electronic assembly connected to the structure and having contacts, wherein the contacts comprise signal contacts and non-signal contacts, wherein the non-signal contacts comprise a ground contact and a power contact arranged in a predetermined arrangement, wherein the electronic assembly is configured for a first type of transmission and a second different type of transmission, wherein the electronic assembly is adapted to receive an active signal conditioning element between the ground contact and the power contact corresponding to the first type of transmission, and wherein the electronic assembly is adapted to alternatively receive a passive electrical component between the ground contact and the power contact corresponding to the second type of transmission.

11. A method as in claim 10 wherein the active signal conditioning element is an active equalization device adapted to improve quality of signals transmitted to the signal contacts, wherein the active equalization device is powered, in operation, by the power to the power contact.

12. A method as in claim 10 further comprising connecting the electrical connector to the electrical cable, wherein:

when the active signal conditioning element is received, the electrical cable is provided having a first longer length, and when the passive electrical component is received, the electrical cable is provided having a second shorter length.

13. A method as in claim 10 comprising configuring the electrical connector to prevent substantive voltage from the non-signal contacts from being carried by the electrical cable when the electrical connector is connected to the cable.

14. Connector assembly comprising:

a first connector having a plurality of first signal contacts and at least one first non-signal contacts in a predetermined arrangement;

a second connector having a plurality of second signal contacts and at least one second non-signal contacts in the same predetermined arrangement, wherein the second connector is adapted to be connected to the first connector, and wherein the second connector comprises a circuit trace element, wherein the circuit trace element has at least one non-signal trace connected to the at least one second non-signal contact and a ground structure, wherein the non-signal trace is adapted to be connected to serve to power a signal conditioning element within the second connector, and wherein the non-signal trace is adapted to be alternatively connected to the ground structure without the signal conditioning element therebetween.

15. Connector assembly of claim 14, wherein the signal conditioning element is an active component.

16. Connector assembly of claim 14, wherein the signal conditioning element is a capacitor.

17. Connector assembly of claim 14, wherein the circuit trace element is a printed circuit board.

* * * * *